United States Patent [19]

Young

[11] 4,374,704

[45] Feb. 22, 1983

[54] APPARATUS FOR PYROLYSIS OF HYDROCARBON BEARING MATERIALS

[76] Inventor: William P. Young, 419 S. Edgewood Ave., La Grange, Ill. 60525

[21] Appl. No.: 203,863

[22] Filed: Nov. 4, 1980

Related U.S. Application Data

[60] Division of Ser. No. 936,367, Aug. 24, 1978, abandoned, which is a continuation of Ser. No. 822,444, Aug. 8, 1977, abandoned.

[51] Int. Cl.[3] ..... C10B 1/08; C10B 1/10; C10B 43/04

[52] U.S. Cl. ..... 202/117; 15/93 A; 202/129; 202/131; 202/218; 202/226; 202/241

[58] Field of Search ..... 48/210; 201/14, 17, 201/35, 18; 202/95, 100, 131, 136, 216, 218, 226, 227, 241, 117, 129; 422/210, 254, 309; 366/221; 432/75, 118; 15/93 A

[56] References Cited

U.S. PATENT DOCUMENTS

| | | | |
|---|---|---|---|
| 1,573,824 | 2/1926 | Griffiths | 202/136 |
| 1,616,777 | 2/1927 | Booth | 202/241 |
| 1,943,291 | 1/1934 | Abbott | 201/18 |
| 1,972,929 | 9/1934 | Fisher | 202/136 |
| 1,980,828 | 11/1934 | Reed et al. | 202/131 |
| 3,071,295 | 1/1963 | Heller | 366/221 |
| 3,756,791 | 9/1973 | Mancke | 201/17 |

*Primary Examiner*—Bradley Garris

[57] ABSTRACT

A process and apparatus for the pyrolysis of coal or other hydrocarbon bearing materials in which the material is fed into the upper end of a rotating cylinder and is heated in a plurality of stages, the heated material passing from the cylinder into a char pit, and treating the resulting materials to separate them into fuels having different characteristics.

One feature of the invention is the addition of CaO or $NaHCO_3$ to the charged materials and addition of $H_2O$ in the char pit to facilitate removal of sulfur.

Another feature is the scraping and brushing of the inside surfaces of the rotary cylinder to clean the interior of the cylinder during the conduct of the process.

7 Claims, 3 Drawing Figures

APPARATUS FOR PYROLYSIS OF HYDROCARBON BEARING MATERIALS

This is a division of application Ser. No. 936,367, filed Aug. 24, 1978, now abandoned which, in turn, is a continuation of application Ser. No. 822,444, filed Aug. 8, 1977, now abandoned.

This invention relates to processes for pyrolyzing hydrocarbon containing materials and to apparatus for carrying out such processes. More particularly the invention relates to the heating of such materials in a rotary kiln to pyrolyzed the materials, discharging the pyrolized products into a chamber, treating these products in the chamber and separating them to produce separate hydrocarbon products of different character.

For many years the by-product coking process has been a source of gas and liquid hydrocarbons. Large quantities of gas and hydrocarbons are made available when the volatile matter in coal is distilled off in the coking process. But the primary purpose of the coke making process is to produce a high quality coke, and what is needed is an improved process for converting coal or other hydrocarbon containing materials such as scrap rubber, plastics, oil bearing shales and tar sands, into gaseous, liquid and solid fuels. It would be desirable, for example, to have a process for effectively converting a high volatile coal having a 35% volatile rating into something like 40–70 gallons of a liquid fuel, 6,000 to 9,000 cubic feet of gas and 1200 pounds of carbon residue, per short ton of coal.

I have discovered a process and apparatus for accomplishing such an objective. One embodiment of my improved process and apparatus is illustrated by the accompanying drawings in which.

Figure 1:
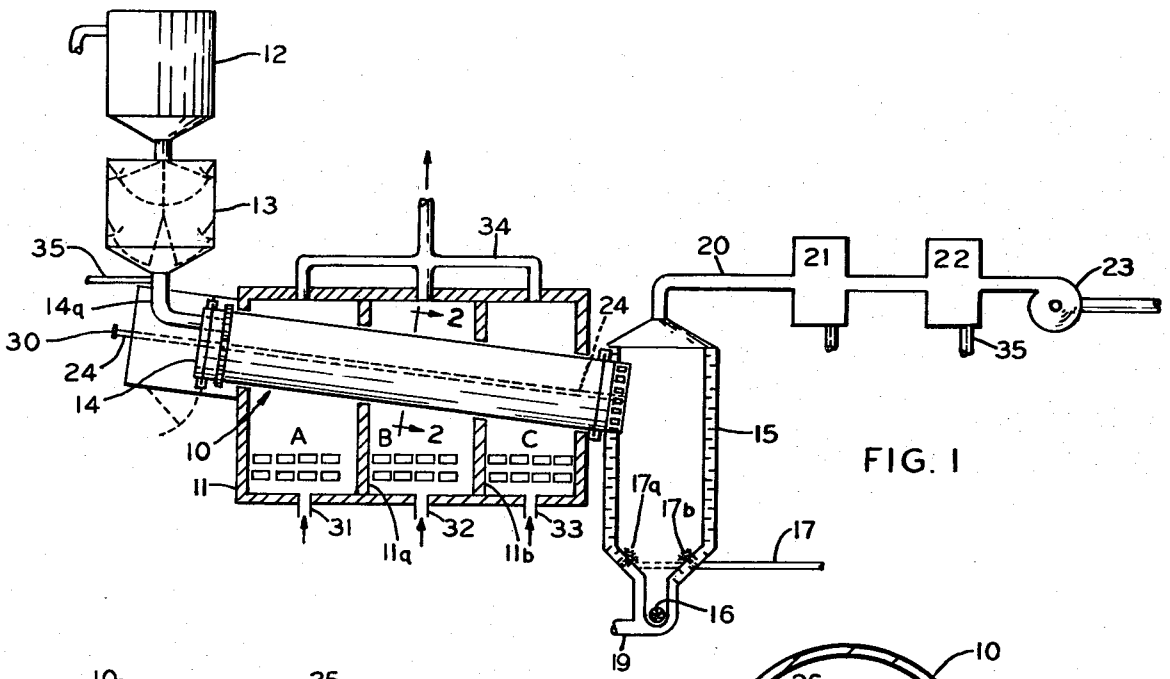
FIG. 1 is a schematic view of improved apparatus for practicing the invention.

As illustrated, the apparatus includes the cylinder 10 of the rotary kiln. This cylinder is mounted for rotation in an inclined position, and is connected at its ends by suitable gearing mechanism with a source of power to drive the cylinder in rotative movement about its longitudinal axis. The angle of inclination should be such as to cause particulate materials within the cylinder to move slowly toward the lower end of the cylinder as the cylinder is rotated. An inclination about $1\frac{1}{2}$ to 4 degrees with the horizontal is generally suitable. The cylinder 10 may be made of stainless steel or other heat resistant metal that will maintain good strength at operating temperatures of the order of 1000° to 1600° F.

The casing 11 extends about the cylinder 10 and has partitions 11*a* and 11*b* so as to provide three combustion chambers A, B and C. The provision of a plurality of such heating chambers along the length of the cylinder is of importance in the present invention for reasons which will later be explained more fully. The number of combustion chambers so provided may vary. There may be two, three or more such chambers.

At the inlet end of the cylinder, I provide a hopper 12 into which the hydrocarbon containing material to be treated is charged. The charged material passes into the airlock device 13. Device 13 is of the double bell type but may be any such device for passing solids therethrough while still maintaining the vacuum condition downstream of the device.

The top end of the cylinder 10 is closed by the cylinder end 14, and the conduit 14*a* is designed to pass the material being processed from the airlock device 13 through the cylinder end 14 into the upper end of the cylinder 10. The upper and lower ends of the cylinder are provided with suitable bearings so that the cylinder rotates about its central longitudinal axis.

The lower end of the cylinder 10 is open and extends into the interior of a device 15 called a char pit. Char pit 15 provides on its interior a chamber into which the material is discharged from the lower end of the cylinder. At the bottom of this chamber is a channel which contains the auger 16. A water pipe 17 leads into the chamber and connects with the spray nozzles 17*a* and 17*b* which discharge water into the hot char pit, forming steam which is brought into contact with materials within this chamber.

Liquid hydrocarbons may be withdrawn through conduit 19 and used for supplying fuel to combustion chambers A, B and C, or used for other purposes.

Gaseous materials within the char pit chamber may be withdrawn at the top of the chamber through conduit 20, passed through a dust collector 21, and then passed through separating equipment 22 which may include one or more condensers and apparatus for separating the sulfur which may come off the char pit chamber. A vacuum pump 23 is provided for drawing the vacuum which extends back through the char pit, the rotary cylinder and up to the air lock of the device 13. A vacuum may be produced which in the char pit is equivalent to an absolute pressure of about 20 to 28.5 inches of mercury.

One of the problems encountered when hydrocarbon materials are heated to high temperatures is that they become gummy and tend to stick to the metals with which they come into contact, forming masses which obstruct operation of the equipment and impede the flow of the materials. This tendency is a problem especially at the inside surfaces of the cylinder where there is no easy access for cleaning.

In the apparatus herein described there is provided devices for scraping and brushing the interior cylindrical surface of the cylinder 10 as the cylinder rotates.

Figure 2:
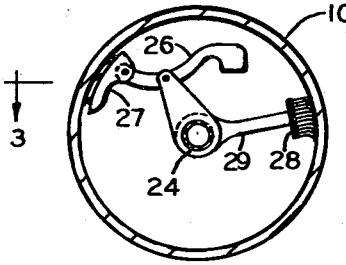
FIG. 2 is a sectional view taken in a plane transverse of the kiln and showing the scraping and brushing devices for clearing the walls of the kiln, this view being taken at line 2—2 of FIG. 1.
Figure 3:
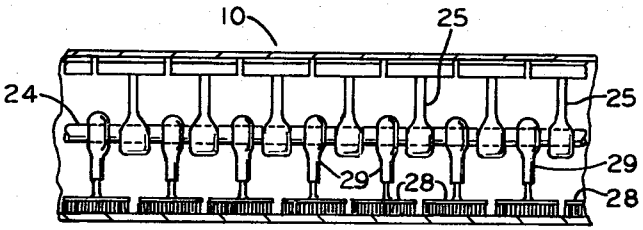
FIG. 3 is a fragmentary sectional view also showing the cleaning devices of FIG. 2, this view being taken along line 3—3 of FIG. 2.

There is shown in each of FIGS. 1, 2 and 3 of the drawing a hollow tube 24 which extends axially of cylinder 10 and runs the full length of the cylinder. Tube 24 is stationary and does not rotate with the cylinder. A scraper device, and also a brushing device is supported on this tube.

The scraping device includes the stationary spaced arms 25 which at their ends are pivotally attached to a central portion of the levers 26. The ends of the levers 26 are pivotally attached to the scraping shoes 27 and the other ends of the levers 26 are weighted.

The brushing device also is secured to tube 24 and the brushes 28 which bear against the interior surface of the cylinder are supported by arm 29 the base of which is attached to the tube 24.

For cooling the tube 24 and the scraping and brushing devices associated with it, I provide a valve 30 which may be turned to allow cooling air, gas, water or other fluid to pass through the tube. It is desirable that the tube be cooled to be sure that it will maintain its rigidity in the hot environment of the kiln interior. Suitably the vacuum which exists in the char pit can be utilized for drawing the cooling fluid through the tube.

OPERATION

In the operation of the illustrated apparatus to carry out my improved process, the material utilized may be coal. The coal may be ground to form a powder and this placed in the hopper 12.

The combustion chambers A, B and C may be preheated by feeding fuel at inlets 31, 32 and 33, and withdrawing flue gases through conduits 34. The cylinder 10 is started in rotation and the vacuum pump 23 made to operate.

The coal passes from hopper 12 through the airlock device 13 and into the upper portion of cylinder 10 where it begins its heat treatment. The material is first heated by the heat developed in combustion chamber A, then as the material passes along the cylinder it comes to be heated by the heat developed in combustion chamber B, and then further down along the cylinder it comes to be heated by the heat developed in combustion chamber C.

The heat at chamber A is held to a degree where the temperature of the material is below the point at which the material becomes liquid but above the point at which some portion of the volatile portions of the coal are taken off. This occurrence raises the temperature at which the remaining material would become liquid.

This permits the heat developed at chamber B to be higher than was developed at chamber A without producing liquifaction; and the removal of a further increment of volatiles, in turn, further raises the temperature at which liquifaction will occur.

Likewise, the temperature of the material heated by chamber C may be still higher to remove further volatile material without exceeding the temperature which would be necessary to liquify the material being treated at that point in the process.

Thus I obtain the advantage just described while passing the material along the interior of the cylinder in a continuously moving stream. By the use of the rotating cylinder which extends through the different heating stages, I am able to keep the material moving continuously through the different stages and avoid clogging which would occur if the material would stop moving between stages or the material be expected to flow through closed pipes from one heating stage to another.

The temperatures to which the material is heated in each stage is relative only, being lower at the initial heating stage and highest at the final stage irrespective of the number of stages that may be provided. The particular temperature will depend also on the volatility of the material being treated. As a specific example, for use in treating coal, chamber A may heat the coal to from 700° to 750° F., the chamber B may heat the material to from 800° to 850° F. and the chamber C may heat the material to from 1150° to 1250° F., but the invention is not to be considered as limited to these specific ranges of temperatures.

The material, in gaseous, liquid or solid form which passes from the lower end of rotating cylinder 10, enters the chamber of the char pit 15. Gases are withdrawn from this chamber and passed through the dust collection and separation equipment including condensers and other equipment known to the art for separating the gaseous material into desired constituents. Cool gas from a condenser may be recirculated through the rotary cylinder to lower the temperature of the gas being evolved by the charge material and thereby decrease the decomposition of light hydrocarbons into heavy hydrocarbons and hydrogen. Conduit 35 leading from a condenser in the equipment 22 to the inlet in the cylinder 10 is provided for this purpose. Conduit 19, leading from the lower part of the char pit, is provided for carrying fuel to one or more of the bombustion chambers A, B or C. These chambers may be equipped to burn gas, liquid or solid fuel. The solid material removed from the char pit by operation of auger 16 may be moved to storage or used for other purposes.

The rate at which cylinder 10 is rotated should be coordinated with the heat developed at chambers A, B and C so that an amount of heat will be absorbed in the material passing through the cylinder which will be sufficient to raise its temperature the desired amount while the material remains in each stage. It is usually suitable that the speed of rotation be, for example, about 5–8 revolutions per minute.

It is a further feature of my invention when the sulfur content of the coal or other hydrocarbon material is so high as to be objectionable, that there be included in the charge placed in hopper 12 a quantity of CaO, suitably in the form of lime, or a quantity of sodium bicarbonate.

By adding CaO or $NaHCO_3$ to the coal, a chemical shift takes place in the first stage of treatment in the rotating cylinder which may be described by the following formula:

$$CaO+S+C \rightarrow CaS+CO$$

or the formula:

$$CaO+FeS \rightarrow CaS+FeO$$

or $$2NaHCO_3+S+C \rightarrow Na_2S+RCO_2+CO+H_2O$$

The resulting sulfur compounds drop into the char pit and meet the steam which is generated by the introduction of water through conduit 17 and sprayed through nozzle 17*a* and 17*b*.

This results in a second chemical shift which is described by the following formula:

$$CaS+2H_2O \rightarrow Ca(OH)_2+H_2S$$

or $$Na_2S+2H_2O \rightarrow 2NaOH+H_2S$$

The hydrogen sulfide so formed is removed at the top of the char pit with other gases and separated out by known methods as previously mentioned.

Although this feature of my process is not expected to separate and remove all the sulfur which may be contained in the coal or other hydrocarbon material, it may be expected to remove more than half the amount so contained.

By introducing lime into a charge material which contains sulfur in an objectionable amount, about 60 pounds per ton of the total charge will result in removal of about 40 pounds of sulfur per ton of charge material processed, and by introducing sodium bicarbonate in such charge material, about 88 pounds per ton of the total charge will result in removal of about 15 pounds of sulfur per ton of the charge material.

Although I have described in detail a single embodiment of the apparatus, it is understood that many changes may be made both in the process and in the apparatus by those skilled in this art, and many other embodiments of the invention may be constructed and utilized, and all such other embodiments and changes are to be considered as within the spirit of the invention and embraced with the scope of the appended claims.

What is claimed:

1. Apparatus for the pyrolysis of hydrocarbon bearing materials comprising: a rotary kiln the axis of which is inclined with respect to the horizontal, means for introducing said material into an upper portion of said kiln, means for rotating said kiln about its axis to cause said material to move within said kiln from its point of introduction toward a lower portion of said kiln, means for heating said material through the walls of said kiln as said kiln rotates and as said material moves within the kiln to a temperature at which a portion of said material is volatile, the lower portion of said kiln having an opening therein through which material may pass out of said kiln, a stationary supporting structure within said kiln, a scraping shoe, and a lever pivotally attached to said structure, said lever being at its one end pivotally connected to said shoe and weighted at its other end, the weight of said weighted end urging said shoe against the wall of said kiln.

2. Apparatus as set forth in claim 1 in which said stationary supporting structure includes a supporting member extending longitudinally of said kiln and an arm secured to and extending radially of said member, said lever being pivotally attached to said arm.

3. Apparatus as set forth in claim 2 including a plurality of said arms spaced longitudinally along said member, a plurality of said scraping shoes spaced longitudinally of said kiln, and a plurality of said levers each of which is pivotally attached to one of said arms and having one end pivotally attached to one of said shoes whereby each of said shoes is permitted to move toward and away from said structure independently of the other shoes to accomodate irregularities in the walls of said kiln.

4. Apparatus for the pyrolysis of hydrocarbon bearing material comprising: a rotary kiln the axis of which is inclined with respect to the horizontal, means for introducing said material into an upper portion of said kiln, means for heating said material through the walls of said kiln as said kiln rotates and as said material moves within the kiln to a temperature at which a portion of said material is volatile, said lower portion of said kiln having an opening therein through which material may pass out of said kiln, means for withdrawing gas through said opening to produce a vacuum within said kiln, stationary supporting structure within said kiln, a scraping shoe, and means pivotally attached to said shoe and to said structure for yieldably urging said shoe outwardly against a wall of said kiln as said kiln rotates.

5. Apparatus as set forth in claim 4 which includes a chamber which communicates through said opening with the interior of said kiln as said kiln rotates and in which said gas withdrawal means functions to withdraw gases from said chamber and by reaction of gas pressure in said chamber to thereby withdraw gas through said opening from the interior of said kiln.

6. Apparatus as set forth in claim 5 which includes means for introducing water into said chamber to enable reaction of the water with materials discharged into said chamber from said kiln.

7. Apparatus as set forth in claim 4 which includes an air lock device for passing solid materials into the kiln while still maintaining a vacuum condition within the kiln.

* * * * *